United States Patent [19]

Lautenschläger et al.

[11] Patent Number: 4,590,641

[45] **Date of Patent: * May 27, 1986**

[54] ADJUSTABLE CROSSLINK HINGE

[75] Inventors: Karl Lautenschläger; Horst Lautenschläger, both of Reinheim; Gerhard W. Lautenschläger, Brensbach, all of Fed. Rep. of Germany

[73] Assignee: Mepla, Inc., High Point, N.C.

[ * ] Notice: The portion of the term of this patent subsequent to Sep. 11, 2001 has been disclaimed.

[21] Appl. No.: 476,391

[22] Filed: Mar. 17, 1983

[30] Foreign Application Priority Data

Mar. 18, 1982 [DE] Fed. Rep. of Germany ..... 3209900

[51] Int. Cl.[4] ..... E05D 7/04

[52] U.S. Cl. ..... 16/238; 16/291; 16/294; 16/370; 16/382

[58] Field of Search ..... 16/370, 352, 353, 333, 16/302, 382, 252, 253, 291, 294, 237, 238, 242, 245, 246, 236

[56] References Cited

U.S. PATENT DOCUMENTS

| | | | |
|---|---|---|---|
| 3,626,548 | 12/1971 | Grunert | 16/370 |
| 3,952,368 | 4/1976 | Zernig et al. | 16/294 |
| 4,290,167 | 9/1981 | Lautenschläger | 16/249 |
| 4,359,803 | 11/1982 | Lautenschläger | 16/382 |
| 4,412,366 | 11/1983 | Rock et al. | 16/236 |
| 4,470,169 | 9/1984 | Lautenschläger | 16/291 |

FOREIGN PATENT DOCUMENTS

| | | | |
|---|---|---|---|
| 2210614 | 9/1973 | Fed. Rep. of Germany | 16/370 |
| 2548551 | 5/1977 | Fed. Rep. of Germany | 16/236 |

*Primary Examiner*—Douglas D. Watts

[57] ABSTRACT

Crosslink hinge for mounting a door on the carcass of a cabinet. The door-related part of the crosslink hinge can be affixed in a recess in the door and is composed of an attaching member and a link holder disposed in the attaching member. To vary the position of the door, the link holder is displaceable at right angles to the pivot axis of the hinge and parallel to the door back and can be fixed in the desired position. The carcass-related part of the hinge has on its bottom an inverted-T-shaped projection which can be inserted into a complementary T-shaped socket in its mounting plate. A set screw is threaded into the mounting plate to fix the carcass-related hinge part thereon.

12 Claims, 15 Drawing Figures

Fig. 4
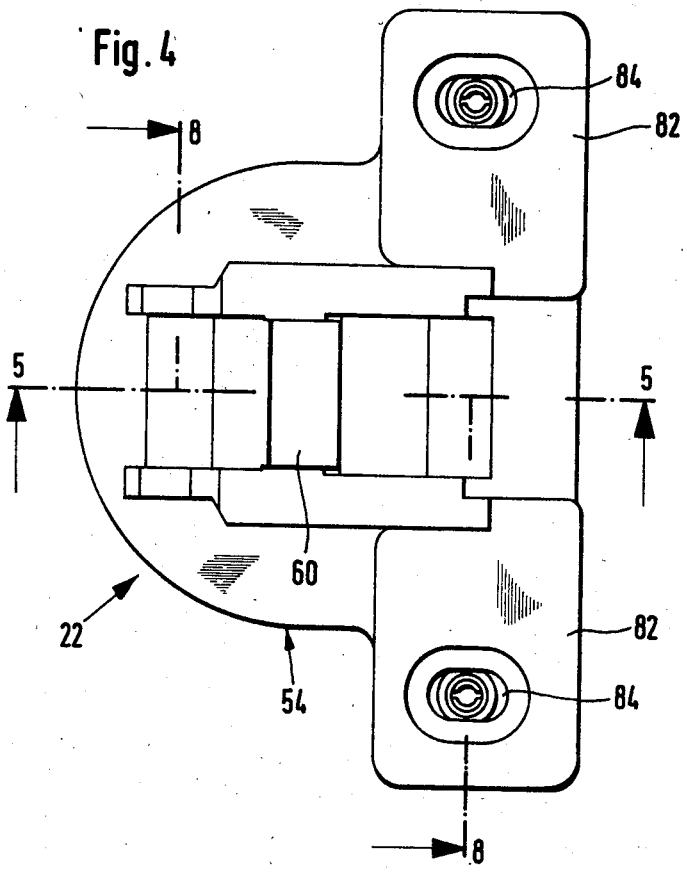
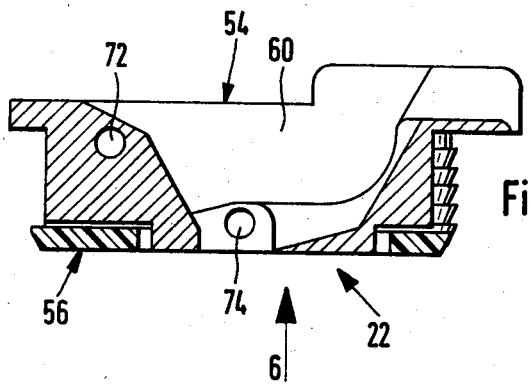
Fig. 5

Fig. 6
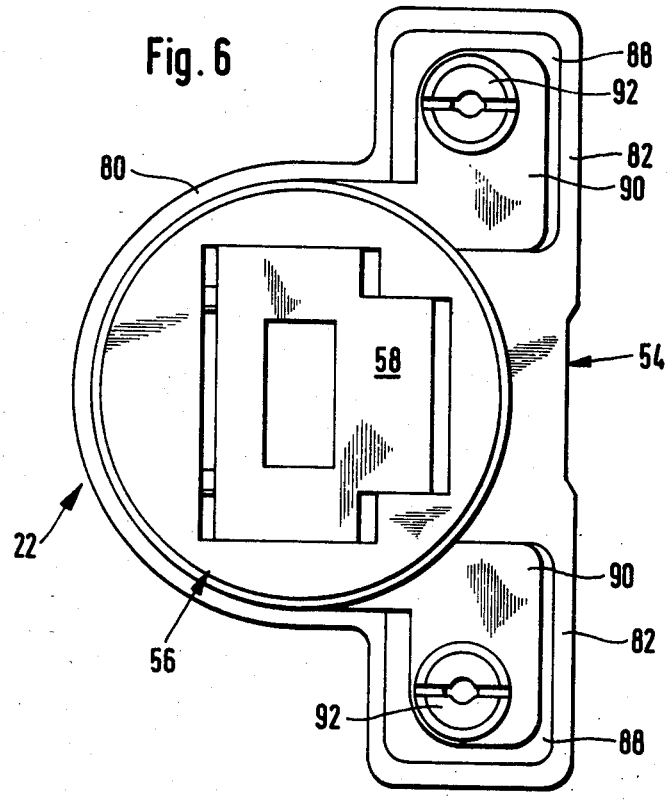
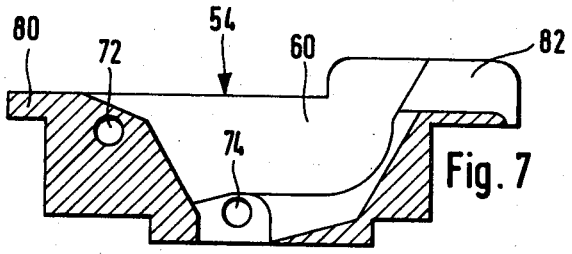
Fig. 7
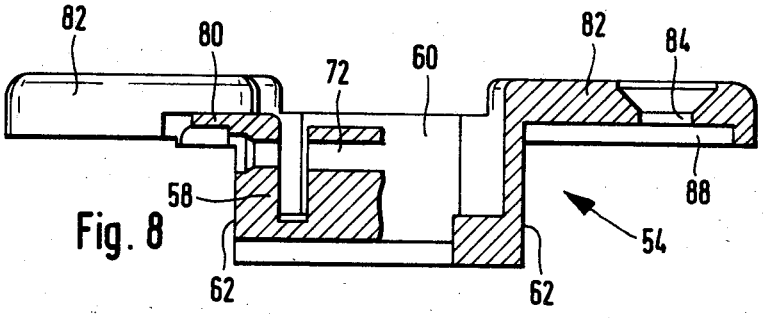
Fig. 8

ADJUSTABLE CROSSLINK HINGE

BACKGROUND OF THE INVENTION

The invention concerns a crosslink hinge for the mounting of a door leaf on the carcass of a cabinet, having two links, each pivoted on the other in a scissor-like manner and one pivotally attached at one end directly to the carcass-related hinge part which can be fastened on a mounting plate on the carcass, and the other joined at one end to the door-related hinge hinge part which is in the form of a cup-like insert which can be set in a recess in the door leaf, the other end of each link pivotally attached to the other hinge part indirectly through a link or a sliding guide means.

Crosslink hinges, which in comparison with other link hinges, such as four-pivot hinges, permit a greater opening angle of as much as 180°, are—like the link hinges used quite generally in modern furniture manufacture for mounting doors on a cabinet carcass—mounted, not directly on the carcass, but releasably and adjustably on a mounting plate attached to the latter. The mounting arrangement is, as a rule, such that the carcass-related part of the hinge is adjustable on the mounting plate in two coordinate directions, namely toward and away from the interior of the cabinet, and at right angles to this direction and to the hinge pivot axis. For the various adjustments, fastening or adjusting screws are provided, which are passed through an adjusting slot in the carcass-related hinge part and driven into a tap in the carcass-related part or they are driven through a tap in the latter and bear against the mounting plate. In the case of crosslink hinges, the carcass-related hinge part, however, is covered over by the section of the link arm that is indirectly coupled to the carcass-related hinge part and points toward the cabinet interior; this link arm is, as a rule, in the form of a metal stamping of U-shaped cross section. The web of this section of the link arm therefore covers over at least a portion of the heads of the fastening or adjustment screws, so that openings must be provided at certain points in this web so that the blade of a screwdriver can be put through them whenever a change of the setting has to be made. Especially in the case of the adjusting screw used in making lateral adjustments in the position of the door on the face of the cabinet, i.e., a change in the overlap of the door, such an opening must be provided because this adjusting screw is, as a rule, situated in an area on the carcass-related hinge part that is close to the door and is covered by the link arm when the door is in the open position, i.e., when the hinge is accessible for adjustment. Such openings, however, detract from the appearance of the hinge. Furthermore, the requirement of accessibility to the adjustment and fastening screws prevents or makes it difficult to provide an over-center mechanism on the carcass-related hinge part in the area covered over by the link arm section, inasmuch as it is not feasible to shift the location of these screws to a point deeper inside the cabinet, not only on account of the resultant greater bulk of the hinge, but also on account of the greater stress it would produce on the fastenings. This is because the weight of the door would then be given a greater mechanical advantage with respect to the mounting and adjusting screws, and this would result in a corresponding increase of the bending stress on the carcass-related hinge part and on the adjusting and fastening screws.

It is therefore the object of the invention to improve the known crosslink hinges such that they will be able to be mounted on a corresponding mounting plate on the carcass in a simple and rapid manner, without increasing their dimensions or the stress applied to them, while preserving simplicity of adjustment, without requiring access to the portion of the carcass-related hinge part that is covered by the link arm for hinge adjustment.

SUMMARY OF THE INVENTION

Setting out from a crosslink hinge of the kind referred to above, this problem is solved in accordance with the invention by causing the door-related hinge part cup to be composed of an attaching means which can be fitted snugly into the door-leaf mortise, and a link holder engaged at least partially in the attaching means, and by making the portion of the link holder that is engaged in the attaching means displaceable within a given range relative to the latter at right angles to the hinge pivot axis and parallel to the back of the door, and enabling it to be fixed in desired positions on the door. In this manner, one of the necessary means of adjustment, namely the adjustment of the carcass-related hinge part to change the amount of the door overlap, is transferred to the door-related part of the hinge, and the formerly required adjusting screw on the carcass-related hinge part is then eliminated.

In a preferred development of the invention, the carcass-related hinge part has on its base a projection of inverted-T-shaped cross section, which can be inserted into an open, complementary T-shaped socket on the mounting plate, and the carcass-related hinge part is provided at its rearward end with an open-ended elongated slot through which a screw is passed and driven into the mounting plate until its head engages the surface of the carcass-related hinge part. In this manner the installation and adjustment of the hinge can be accomplished simply by inserting the projection into the socket and locking it at the desired depth therein by tightening the screw passed through the open-ended elongated slot, the head of the screw being accessible at the inner end of the carcass-related hinge part since the link-arm section of the latter leaves the screw exposed even when the door is only partially open.

The link holder of the door-related hinge part preferably has a flange lying against the back of the door and concealing the attaching means in any of the positions in which the link holder may be fixed, so that, when the hinge is installed, the attaching means is not at all visible.

The flange of the link holder is best made in the form of an over-sized mounting flange in the area opposite the edge of the door, and on it at least one hole elongated in the direction of the adjustment of the link holder is provided for the accommodation of an associated mounting screw.

The flange then has on its underside facing the door leaf a shallow recess in which at least one flat, ear-like projection of the attaching means is accommodated, which is smaller than the recess by the amount of the given displaceability of the link holder relative to the attaching means.

The ear-like projection can have in the portion situated beneath an elongated hole in the fastening flange of the link holder a mounting plug projecting toward the door, this plug being driven into a mating bore in the reverse side of the door and additionally holding the insert on the door.

It is then desirable to make the mounting plug expandable in diameter by means of the mounting screw that is driven into it, in order thus to achieve maximum strength in the mounting of the insert in its mortise in the door.

The attaching means is preferably injection-molded of plastic, the ear or ears along with the (expandable) plugs, if used, being made integral therewith.

The link holder, on the other hand, is made preferably of metal, and it is recommendable that it be made by pressure casting—by die casting from zinc alloy, for example.

In the case of a crosslink hinge in which the link arm pivotally attached directly to the door-related hinge part is coupled by a link to the carcass-related hinge part, the design is preferably such that the link arms and the link indirectly coupling the link arm with the carcass-related hinge part have two cheeks in parallel spaced relationship, between which an over-center mechanism holding the hinge in the closed position is disposed. Since the mounting screws or adjusting screws are no longer situated in the area between the supporting-wall-related hinge part and the link arms, there is no longer any difficulty in providing such an over-center mechanism in this area.

In a preferred further development of the invention, this over-center mechanism has a two-armed cam lever pivoted on the carcass-related hinge part, whose arm adjacent the door is biased toward contact with the carcass-related hinge part, while the upper side of the second lever arm is in the form of a cam which, with in the immediate vicinity of the closed position, cooperates with an actuating means provided between the cheeks of the link such that the lever arm on the door side is held lifted away from the carcass-related hinge part against the bias of the spring.

The lever arm at the door end is best configured and arranged such that, when the closed position is approached, it will overreach the pivot pin joining the crosslink arms together in a scissor-like manner, a roller being preferably mounted on the pivot pin and engaging the cam surface on the bottom side of this lever arm before the other lever arm is released by the actuating means. The actuating means cooperating with the cam surface of the cam lever end remote from the door-related hinge part can be simply a transverse pin whose ends are held in bores in the cheeks of the link.

BRIEF DESCRIPTION OF THE DRAWING

The invention is further explained in the description that follows of an embodiment, in conjunction with the drawing, wherein:

FIG. 4 is a top view of the door-related hinge part in a position turned 180° with respect to FIG. 3;

FIG. 5 is a cross section along line 5—5 of FIG. 4;

FIG. 6 is a bottom view of the door-related hinge part as seen in the direction of the arrow 6 in FIG. 5;

FIG. 7 is a cross section corresponding to that of FIG. 5, through the link holder of the door-related hinge part shown in FIGS. 4 to 6;

FIG. 8 is a cross section through the link holder of FIG. 7 as seen in the direction of arrows 8;

DETAILED DESCRIPTION OF PREFERRED EMBODIMENTS

Figure 1:
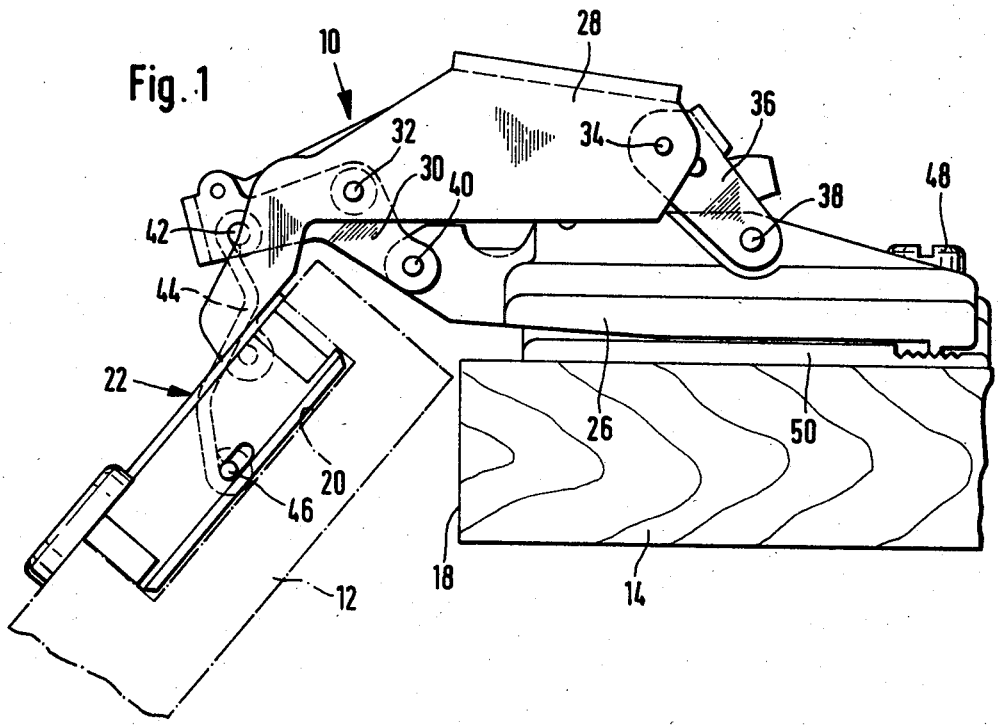
FIGS. 1 and 2 are side views of the hinge of the invention, and of its mounting on the supporting wall of a cabinet carcass, the open position being shown in FIG. 1 and the closed position in FIG. 2.
Figure 2:
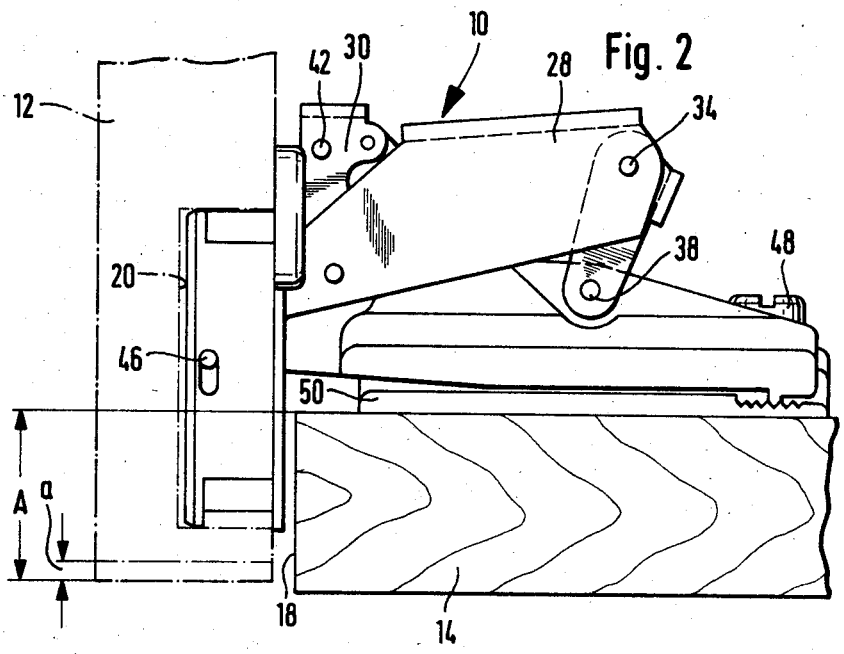
Figure 3:
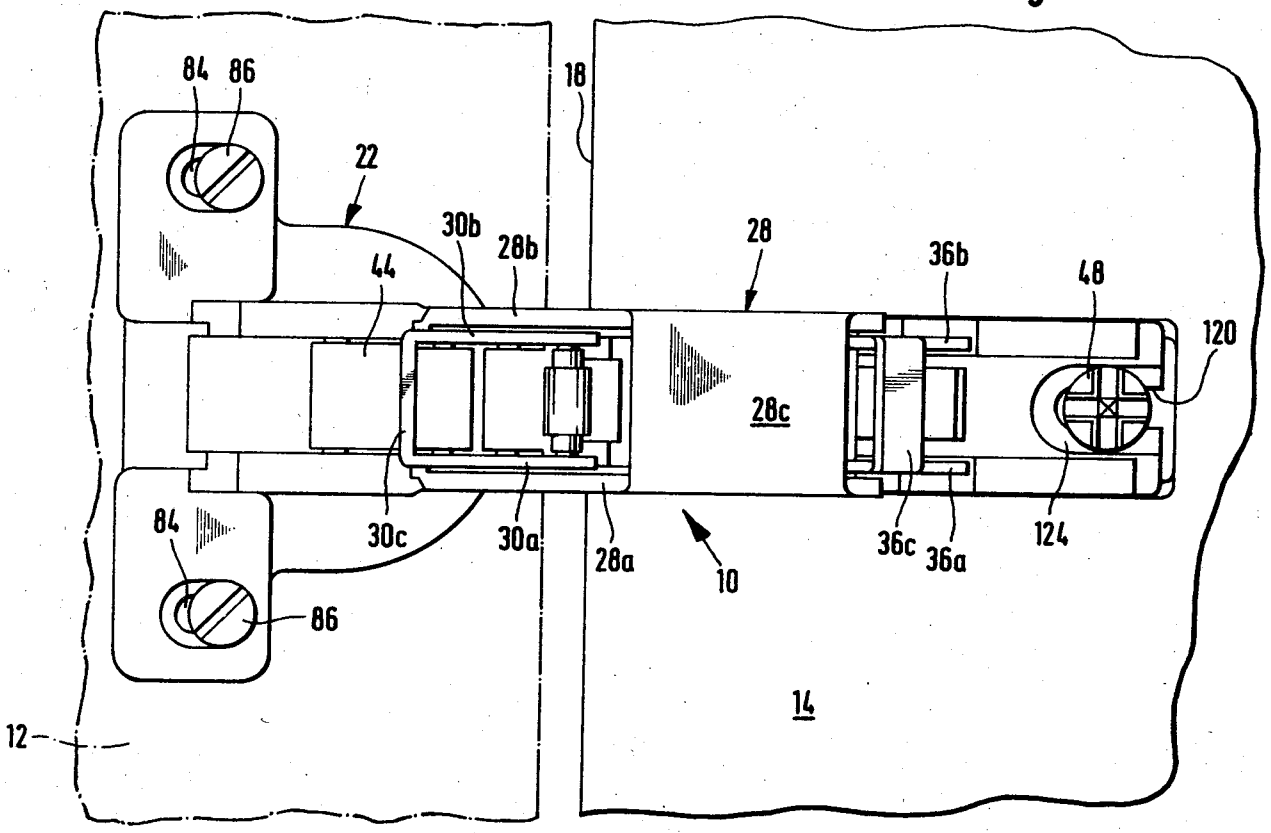
FIG. 3 is a top view of the hinge shown in FIGS. 1 and 2, in a position wherein the door leaf with the hinge mounted on it is open at 90° from the closed position.
Figure 9:
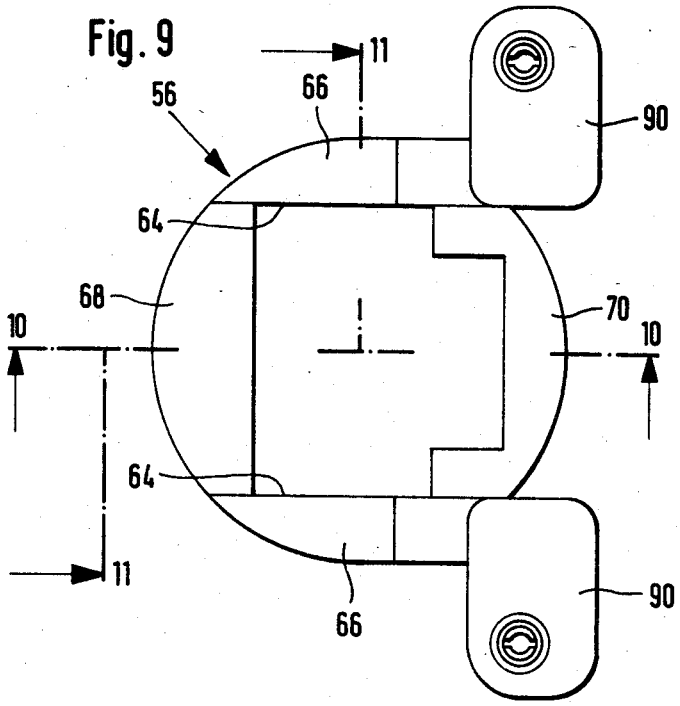
FIG. 9 is a top view of the means for attaching the door-related hinge part, as seen in the direction of the arrow 9 in FIG. 10.
Figure 10:
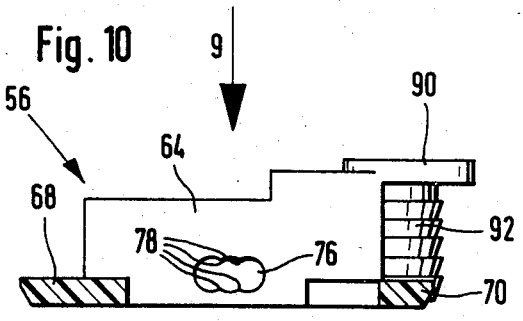
FIG. 10 is a cross section through the fastening portion as seen in the direction of the arrows 10—10 of FIG. 9.
Figure 11:
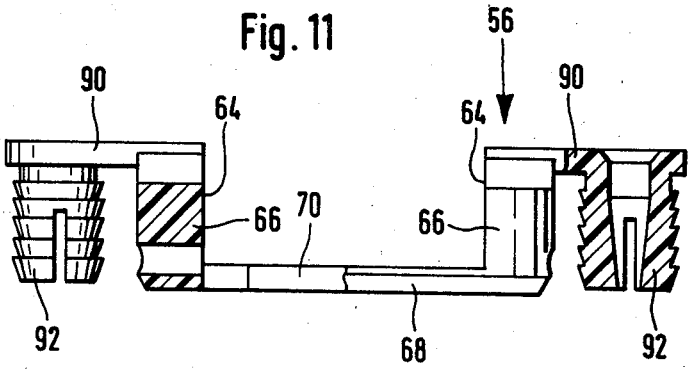
FIG. 11 is a front view, partially in section, of the fastening portion shown in FIGS. 9 and 10, as seen in the direction of the arrows 11—11 of FIG. 9, the expansion plug represented on the right side of the drawing being shown in cross section.
Figure 12:
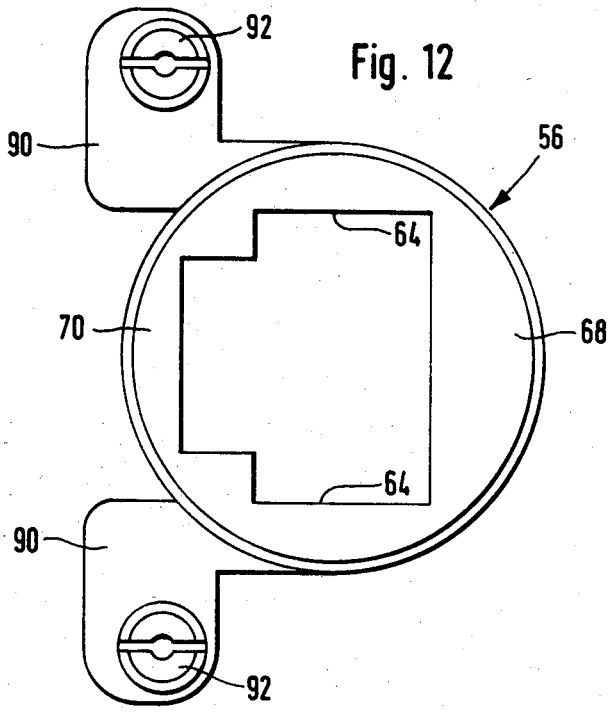
FIG. 12 is a bottom view of the fastening means shown in FIGS. 9 and 11.

The hinge shown in FIGS. 1 to 3 and indicated as a whole by the number 10 serves for the pivotal mounting of a door leaf 12 on a supporting wall 14 of a cabinet carcass, the door leaf 12 overlapping the outer edge 18 of the supporting wall 14 by a given amount A which is adjustable within a range a in order that the door may be in proper position when it is in the closed state (FIG. 2).

Figure 15:
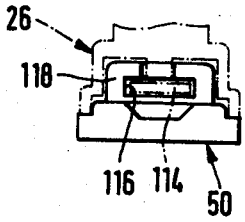
FIG. 15 is a view of the mounting plate of the hinge of the invention, as seen in the direction of the arrow 15 of FIG. 14, the carcass-related hinge part that is fastened on the mounting plate being indicated diagrammatically in broken lines.

The door-related part of the hinge, which is in the form of an insert 22 which can be set in a recess 20 in the door 12, and also the carcass-related hinge part 26, which can be fastened on the inside face of the supporting wall 14, are pivotally joined by a crosslink mechanism. This crosslink mechanism consists of two crosslink arms 28 and 30 which are pivoted on one another by a pin 32 in a scissor-like manner. The crosslink arm 28 is pivoted at its left-hand extremity, as seen in the drawing, directly within the insert 22, while its end on the carcass side is pivoted at 34 to a link 36 which in turn is pivoted at 38 on the inside end of the carcass-related hinge part 26. The second crosslink arm 30 is pivoted on the one hand directly at 40 to the carcass-related hinge part 26, while its other end is pivoted at 42 to a link whose other end is pivotally attached at 46 inside of the insert 22. The basic construction of this crosslink mechanism to the extent described above is known. The crosslink arms 28 and 30 as well as the link 36 are stamped from sheet metal and have each two parallel cheeks 28*a*, 28*b*, 30*a*, 30*b* and 36*a*, 36*b*, integral with the webs 28*c*, 30*c* and 36*c*. The carcass-related hinge part 26 is mounted adjustably on its mounting plate 50 by means of a screw 48 in the manner yet to be described in conjunction with FIGS. 13 to 15. The mounting plate 50 is, in turn, fastened to the inside surface of the supporting wall 15 by screws or other conventional means.

The special construction of the door-related hinge part in the form of the insert 22 will be further explained below in conjunction with FIGS. 4 to 12, FIGS. 4 to 6 showing the assembled insert composed of the link holder 54 and the attaching means 56, while in FIGS. 7 and 8 the link holder 54 is shown separately, and in FIGS. 9 to 12 the fastener 56 is shown separately.

The link holder 54, made preferably by die-casting from metal, has a guide piece 58 which can be inserted into the attaching means 56 made of plastic, in which a recess 60 is formed, in which recess the front sections of the crosslink arms 28 and 30, the front or door end of the carcass-related hinge part 26, and a section of the link 44, are contained when the hinge is in the closed state. The guide piece 58 has on its sides planar surfaces 62 (FIG. 8) which lie between likewise planar inner surfaces 64 (FIG. 11) of the attaching means 56. The attaching means consists virtually of two sections 66 of more or less segmental shape in plan (FIGS. 9 and 11) which are joined together integrally in their bottom area by two cross members 68 and 70, the circular outer periphery of the moldings 66 and cross members 68 and 70 being equal to the diameter of the recess 22 in the door 12. The attaching means 56 thus fits into the insert 22 and is therefore held in the insert against any displacement parallel to the surfaces of the door. On the other hand, the guide piece 58 is shorter in the direction parallel to the surfaces 62 and 64, respectively, than the diameter of the insert 22, so that the guide piece—and thus the entire link holder 54—is held between the moldings 66 so as to be displaceable by a certain amount in this direction.

The bore 72 which can be seen in the link holder in FIGS. 5, 7 and 8, serves to accommodate a pivot pin joining the front end of the crosslink arm 27 directly to the link holder, while bore 74 (FIGS. 5 and 7) serves to accommodate a pivot pin holding the link 44 in the link holder at the door end. An elongated hole 76 in molding 66 corresponds to the bore 74, and into it projects the pivot pin of appropriate length for the link 44, and thus secures the link holder also against removal from the attaching means. The guide piece 58 of the link holder 54 is therefore displaceable within the attaching means 56 over a range given by the length of the elongated holes 76, while projections 78 (FIG. 10) provided on the lateral longitudinal surfaces of the elongated holes 76 hold the pivot pin in a central displacement position. Due to the resilience of the plastic material of the attaching means, the pivot pin can nevertheless be pushed with moderate effort over the projections 78.

The link holder 54 has a radial flange 80 which projects radially from the upper margin of the guide piece 58 and overlaps the attaching means 56 in any position of the latter, and which is expanded in the area opposite the edge of the door 12 into an enlarged fastening flange having two wings 82 extending on both sides of and symmetrically with the longitudinal central axis of the link holder and being provided each with an elongated hole 84 aligned with the direction of displacement of the link holder relative to the attaching means (FIGS. 3 and 4). Mounting screws 86 (FIG. 3) screwed through these elongated holes 84 into the door 12 hold the link holder 54 and with it the entire door-related hinge part in the desired position of adjustment on the door 12.

The bottoms of the flange wings 82 facing the door 12 are provided with shallow recesses 88 (FIG. 6 and 8) in which there are situated ear-like, flat projections 90 projecting radially from the upper edge of the attaching means 56 (FIGS. 6, 9 and 12), which are shorter in the direction of displacement than the recesses 88, so that they permit displacement of the link holder relative to the attaching means. Each of the ear-like projections 90 is provided in the area situated beneath the corresponding elongated hole 84 with an expansion plug 92 which can be expanded by the mounting screws 86. The mounting screws 86, therefore, are not directly driven into the material of the door 12 in the example here represented, although it is basically possible for this to be the case; instead, they are driven into the expansion plugs 92 which in turn are forced into associated bores (not shown) in the door. The expansion of the expansion plugs 92 when the mounting screws 86 are driven into them provides on the one hand a means of fastening the door-related hinge part 22 to the door such that it can withstand heavy loads, but on the other hand can be removed at any time and reinstalled. The ear-like projections 90 and the expansion plugs 92 are preferably injection molded integral with the attaching means 56.

Figure 13:
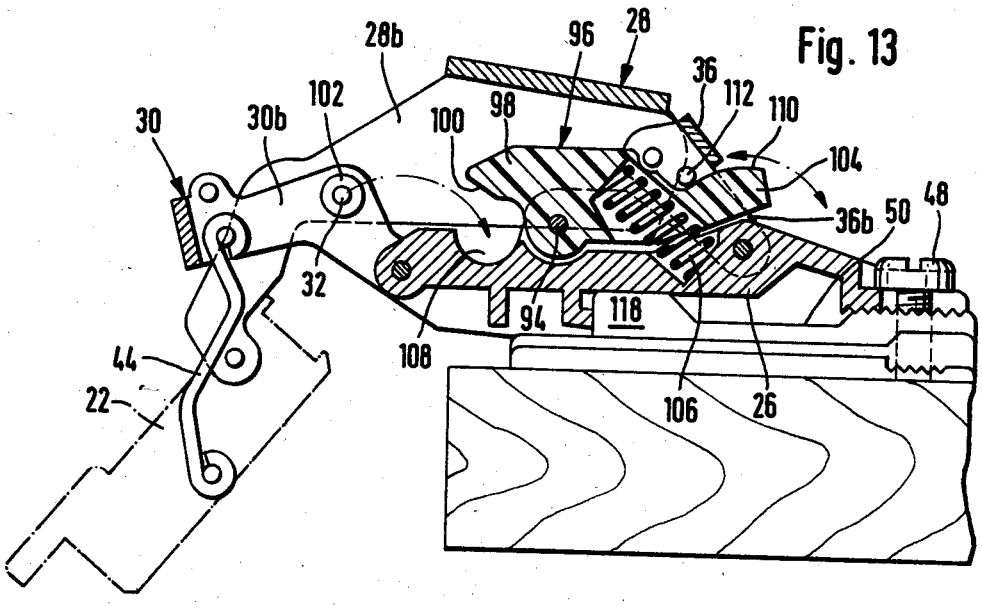
FIGS. 13 and 14 are diagrammatic cross sections along the longitudinal center plane of the hinge of the invention in the open and closed positions, respectively, an over-center mechanism provided for catching the hinge in the closed position being represented diagrammatically, FIG. 14 showing the carcass-related hinge part elevated above the mounting plate which is represented partially in cross section in the area of the socket.
Figure 14:
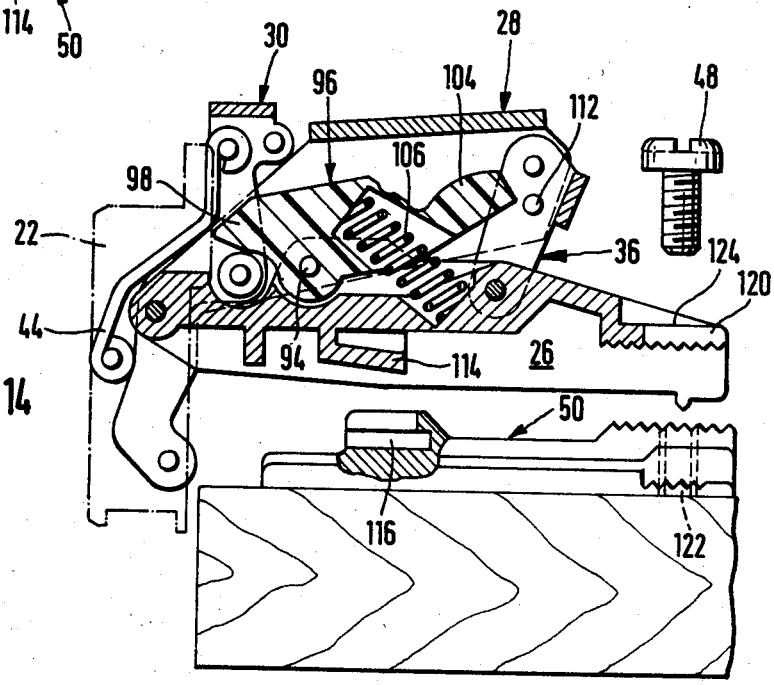

FIGS. 13 and 14 diagrammatically represent the manner in which the carcass-related hinge part 26 is fastened on the mounting plate, and the configuration and arrangement of an over-center mechanism holding the hinge 10 in the closed position, which is disposed on the carcass-related hinge part in the space between the cheeks of the crosslink arms 20 and 30 and the link 36. The over-center mechanism consists essentially of a two-armed cam lever 96 pivotally mounted at 94 on the carcass-related hinge part 26. Its first lever arm 98 adjacent the door-related hinge part 22, has on its bottom a cam 100 which, when the hinge approaches the closed state (FIG. 14), cooperates with a roller 102 mounted on a pin 32 which joins the crosslink arms 20 and 30 together in a scissor-like manner. To this end, the inside, second lever arm 104 is biased by a compression spring 106 abutting on the carcass-related hinge part 26 such that the first lever arm 98 is urged toward the upper side of the carcass-related hinge part. In the upper side of the carcass-related hinge part there is provided a recess 108 in which the roller 102 lies when the hinge is in the closed state.

The upper side of the second lever arm 104 is in the form of a cam 110 on which rides a pin 112 disposed transversely between the cheeks **36*a* and 36*b* of link 36, thereby holding the first lever arm 98 away from the carcass-related hinge part 26. Not until the instant in which the transverse pin 112 comes free of the cam 110 will the cam lever 96 swing counterclockwise. In accordance with the action of the crosslink mechanism and the length of the second lever arm 104, the release of the cam 110 by the pin 112, however, does not take place until just before the door reaches the closed position, when the roller 102 is already running against the cam 100 on the bottom of the lever arm 98. Upon the release of the cam lever by the pin 112, therefore, the force of spring 106 exercises a component acting in the closing direction between the cam 100 and the roller 102**.

The fastening of the carcass-related hinge part on the mounting plate 50 so as to be adjustable longitudinally can be understood with the aid of FIGS. 13 to 15 and FIG. 3. The carcass-related hinge part 26 partially overlapping the mounting plate 50 has in its front area towards the door 12 a downwardly projecting, inverted-T-shaped projection 114 (FIG. 14, and in broken lines in FIG. 15), which can be inserted into a correspondingly T-shaped open socket 116 in a projection 118 of the mounting plate. By means of the projection 114 inserted into the socket 116, the carcass-related hinge part 26 is held securely on the mounting plate against lifting from the latter. To set the depth to which the carcass-related hinge part 26 can be inserted on the mounting plate (it is variable to a certain degree and hence adjustable), there is provided on the rearward end of the carcass-related hinge part 26 pointing toward the carcass interior, a slot 120 open on the inside end, through which the mounting screw 48 can be driven into a threaded bore 122 (FIG. 14) on the rearward end of the mounting plate 50 to such an extent that the bottom of its head presses against the planar bearing surface 124 around the slot 120 and thus clamps the carcass-related hinge part onto the mounting plate. Indentations in the confronting surfaces of the carcass-related hinge part and mounting plate additionally secure the carcass-related hinge part in the selected depth of insertion against undesired displacement.

In order on the one hand to facilitate the introduction of the projection 114 into the socket 116, and on the other hand to reduce to the vanishing point the insertion clearance between the laterally projecting arms of the T-shaped projection 114 and the socket 116, i.e., to assure the rigid fastening of the carcass-related hinge part 26 on the mounting plate 50, the arms of the T of projection 114 are made to slope slightly toward the supporting wall of the carcass, in the manner seen in FIG. 14.

We claim:

1. A crosslink hinge for pivotally mounting a door leaf having a back face, to a carcass of a cabinet about a hinge pivot axis, said hinge comprising: a carcass-related hinge part; a door leaf related hinge part; first and second link arms each having one end, another end, and a middle region therebetween; said arms being joined pivotingly to each other in said middle regions thereof in a scissor-like manner, said first link arm being joined at said one end thereof to said carcass-related hinge part, said second link arm being joined at said one end thereof to said door leaf related hinge part; said door leaf related hinge part being a bipartite cup-like insert adapted to be set in a recess in the back face of the door leaf, said first and second link arms at said other ends being coupled to said door leaf related hinge part and carcass-related hinge part respectively; said carcass-related hinge part having a bottom, a projection in said bottom in an area near said hinge pivot axis, said projection having an approximately inverted-T-shaped cross section; and a mounting plate to be secured to the cabinet carcass and having a socket of T-shape complementary to that of said projection, said projection being received in said socket; said socket being open at a top thereof facing said carcass-related hinge part and at a front end thereof facing said door-leaf back side, and said carcass-related hinge part at an end pointing into the interior of the carcass being provided with an open-ended longitudinal slot through which a shank of a mounting screw is adapted to be threaded into said mounting plate until a head of the screw engages an upper side of the carcass-related hinge part; said bipartite insert comprising: an attaching means adapted to be matingly inserted into the door recess, and a link holder having at least a portion sunkenly engaged in a recess of said attaching means and being displaceable by a given amount relative to said attaching means at right angles to said hinge pivot axis and parallel to the back side of the door leaf, and adapted to be fastened on the door leaf at any desired position within said given amount of displacement, said link holder having a flange lying upon the back side of the door leaf and covering said attaching means in all relative displacement positions, said flange, in the area opposite an edge of the door leaf, forming an enlarged mounting flange, at least one elongated hole in said mounting flange and disposed in the direction of displacement of said link holder relative to said attaching means for the passage therethrough of the shank of an associated mounting screw, said mounting flange having a bottom facing the back side of the door leaf, said bottom having a shallow recess, said attaching means having at least one flat, ear-like projection engaging said recess, said projection being smaller than said recess by said given amount of displacement of said link holder relative to said attaching means.

2. A crosslink hinge according to claim 1, wherein said at least one ear-like projection has in the area beneath each elongated hole in the mounting flange of the link holder, a mounting plug projecting toward the door leaf.

3. A crosslink hinge according to claim 2, wherein said mounting plug is in the form of an expansion plug whose diameter is enlargeable by the threaded shank of said mounting screw driven into said plug.

4. A crosslink hinge according to claim 1, wherein said attaching means and said at least one ear-like projection is an integral, injection-molded piece of plastic.

5. A crosslink hinge according to claim 2, wherein said attaching means, said at least one ear-like projection, and said mounting plug is an integral, injection-molded piece of plastic.

6. A crosslink hinge according to any one of claims 1 to 5, comprising a link indirectly coupling said second link arm to said carcass-related hinge part, said link arms and said link each having two cheeks disposed in parallel spaced relationship to each other, and an over-center mechanism holding the hinge in a closed position being disposed between said cheeks, said over-center mechanism having a two-armed cam lever pivotally mounted on said carcass-related hinge part in the space between said cheeks of said link arms and of said link, said lever having a lever arm facing said door leaf-related hinge part, said lever arm being resiliently biased towards engagement with said carcass-related hinge part, said lever arm having an upper side pointing away from the door leaf-related hinge part in the form of a cam which, with the exception of hinge positions directly adjacent the closed position, cooperates with an actuating element provided between the cheeks of the link such that the lever arm pointing toward the door leaf-related hinge part is held lifted from the carcass-related hinge part against spring bias.

7. A crosslink hinge according to claim 6, wherein a pivot pin joins said link arms together in a scissor-like manner, said pivot pin, upon approach to the hinge-closed position, coming into contact with the lever arm of the cam lever that points toward the door leaf-related hinge part before said actuating element comes out of engagement with said cam of said other lever arm of said cam lever.

8. A crosslink hinge according to claim 7, wherein, in the space between the cheeks of the link arms, a roller is mounted on said pivot pin which joins the link arms together in a scissor-like manner, and, as the hinge-closed position is approached, runs onto the bottom of the associated lever arm, which is in the form of a cam.

9. A crosslink hinge according to claim 6, wherein said actuating element cooperating with the cam of the lever arm pointing away from the door leaf-related hinge part is a transverse pin whose ends are held in bores in the cheeks of the link.

10. A crosslink hinge according to claim 7, wherein said actuating element cooperating with the cam of the lever arm pointing away from the door leaf-related hinge part is a transverse pin whose ends are held in bores in the cheeks of the link.

11. A crosslink hinge according to claim 8, wherein said actuating element cooperating with the cam of the lever arm pointing away from the door leaf-related hinge part is a transverse pin whose ends are held in bores in the cheeks of the link.

12. A crosslink hinge for pivotally mounting a door leaf having a back face, to a carcass of a cabinet about a hinge pivot axis, said hinge comprising: a carcass-related hinge part; a door leaf related hinge part; first and second link arms each having one end, another end, and a middle region therebetween; said arms being joined pivotingly to each other in said middle regions thereof in a scissor-like manner, said first link arm being joined at said one end thereof to said carcass-related hinge part, said second link arm being joined at said one end thereof to said door leaf related hinge part; said door leaf related hinge part being a bipartite cup-like insert adapted to be set in a recess in the back face of the door leaf, said first and second link arms at said other ends being coupled to said door leaf related hinge part and carcass-related hinge part respectively; said carcass-related hinge part having a bottom, a projection in said bottom in an area near said hinge pivot axis, said projection having an approximately inverted-T-shaped cross section; and a mounting plate to be secured to the cabinet carcass and having a socket of T-shape complementary to that of said projection, said projection being received in said socket; said socket being open at a top thereof facing said carcass-related hinge part and at a front end thereof facing said door-leaf back side, and said carcass-related hinge part at an end pointing into the interior of the carcass being provided with an open-ended longitudinal slot through which a shank of a mounting screw is adapted to be threaded into said mounting plate until a head of the screw engages an upper side of the carcass-related hinge part; said bipartite insert comprising: an attaching means adapted to be matingly inserted into the door recess, and a link holder having at least a portion sunkenly engaged in a recess of said attaching means and being displaceable by a given amount relative to said attaching means at right angles to said hinge pivot axis and parallel to the back side of the door leaf, and adapted to be fastened on the door leaf at any desired position within said given amount of displacement; a link indirectly coupling said second link arm to said carcass-related hinge part, said link arms and said link each having two cheeks disposed in parallel spaced relationship to each other, and an over-center mechanism holding the hinge in a closed position being disposed between said cheeks, said over-center mechanism having a two-armed cam lever pivotally mounted on said carcass-related hinge part in the space between said cheeks of said link arms and of said link, said lever having a lever arm facing said door leaf-related hinge part, said lever arm being resiliently biased towards engagement with aid carcass-related hinge part, said lever arm having an upper side pointing away from the door leaf-related hinge part in the form of a cam which, with the exception of hinge positions directly adjacent the closed position, cooperates with an actuating element provided between the cheeks of the link such that the lever arm pointing toward the door leaf-related hinge part is held lifted from the carcass-related hinge part against spring bias.

* * * * *